United States Patent [19]

Röck et al.

[11] Patent Number: 4,842,351

[45] Date of Patent: Jun. 27, 1989

[54] DRAWER METAL SIDE WALL WITH HOOKS FOR CONNECTION TO DRAWER BOTTOM PLATE

[75] Inventors: Erich Röck, Höchst; Helmut Hollenstein, Lustenau, both of Austria

[73] Assignee: Julius Blum Gesellschaft m.b.H., Höchst, Austria

[21] Appl. No.: 154,216

[22] Filed: Feb. 10, 1988

[30] Foreign Application Priority Data

Mar. 5, 1987 [AT] Austria ..... 496/87

[51] Int. Cl.[4] ..... A47B 48/00

[52] U.S. Cl. ..... 312/263; 312/330 R; 403/283

[58] Field of Search ..... 403/278, 283; 312/263, 312/330 R

[56] References Cited

U.S. PATENT DOCUMENTS

| | | | |
|---|---|---|---|
| 3,432,061 | 3/1969 | Anderson | 312/330 X |
| 4,191,439 | 3/1980 | Cohen | 312/263 X |
| 4,462,647 | 7/1984 | Key | 312/257 R |

FOREIGN PATENT DOCUMENTS

| | | | |
|---|---|---|---|
| 2702217 | 7/1978 | Fed. Rep. of Germany | 312/330 R |

*Primary Examiner*—Joseph Falk

*Attorney, Agent, or Firm*—Wenderoth, Lind & Ponack

[57] ABSTRACT

A drawer has metal side walls with vertical flanges thereof forming the lateral limits of the drawer. Each vertical flange has at a lower end thereof a horizontal flange on which a drawer bottom plate of wood or the like abuts. Hooks are punched from the horizontal flanges and project into recesses in the bottom plate. The hooks are bendable and have angular tips pierced into walls of the recesses.

2 Claims, 3 Drawing Sheets

DRAWER METAL SIDE WALL WITH HOOKS FOR CONNECTION TO DRAWER BOTTOM PLATE

FIELD AND BACKGROUND OF THE INVENTION

The invention relates to a drawer with metal side walls, each having a vertical flange forming a lateral limitation of the drawer. Horizontal flanges extend from the lower ends of the vertical flanges and support a bottom plate of wood or the like. A plurality of hooks are punched out of the horizontal flanges of the drawer side walls and project into continuous grooves extending parallel to the lateral edges of the bottom plate.

Generally, rails with L-, U- or Z-shaped profiles are fastened to the side walls of a drawer and form pull-out rails of a pull-out guide assembly. A drawer with side walls made of metal is disclosed in DE-A 27 02 217. The drawer side walls are Z-shaped and have upper horizontal flanges serving as running flanges for supporting rollers at the sides of a furniture body, and thus replace separate pull-out rails. Hooks are bent out from lower horizontal flanges and project into openings of a bottom plate.

SUMMARY OF THE INVENTION

It is the object of the invention to provide an improved drawer of the above-described type, and particularly wherein anchoring of the bottom plate to the drawer side walls is improved and the parts of the drawer are more securely connected to one another.

According to the invention this object is achieved in that the hooks are bendable and are clamped into a side wall of the groove by means of angular tips projecting substantially at a right angle to the hooks and piercing into the material of the bottom plate.

Particularly secure fastening is obtained in that the tips of the bent hooks of each drawer side wall are directed towards the vertical flange of the side wall.

BRIEF DESCRIPTION OF THE DRAWINGS

In the following an embodiment of the invention will be described in more detail with reference to the accompanying drawings, in which.

DETAILED DESCRIPTION OF THE INVENTION

Figure 1:
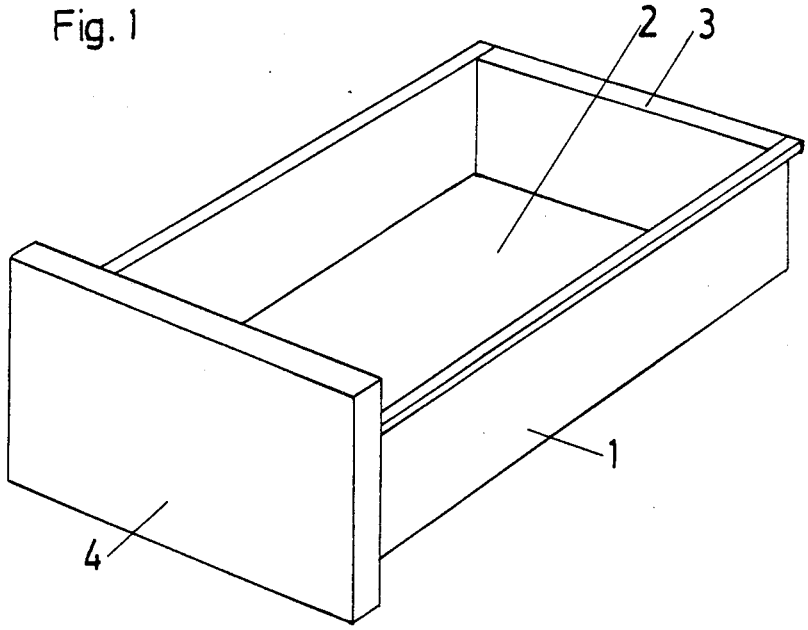
FIG. 1 is a perspective view of a drawer according to the invention.

A drawer according to the invention includes side walls 1, a bottom plate 2, a rear wall 3 and a front plate 4, as shown in FIG. 1. The rear wall 3 and the front plate 4 as well as their connection with the drawer side walls 1 will not be further described herei as they are not essential to the present invention.

Figure 2:
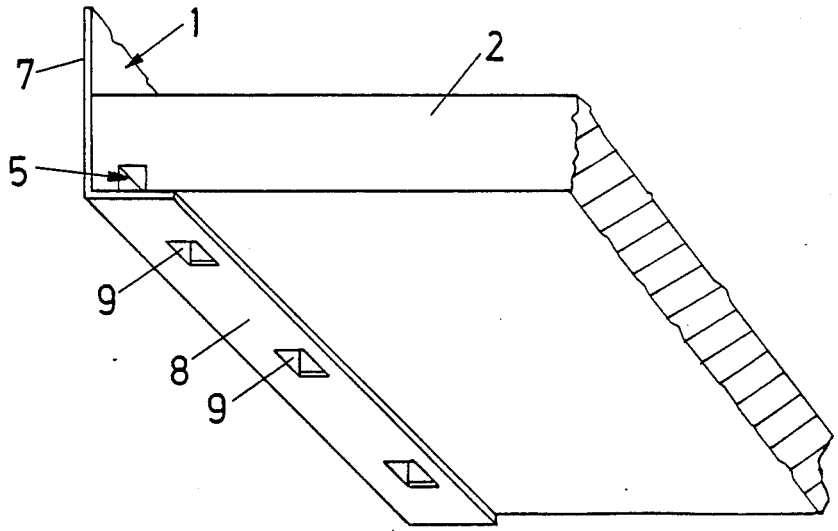
FIG. 2 is a partial perspective view of a connection between a drawer side wall and a bottom plate.
Figure 3:
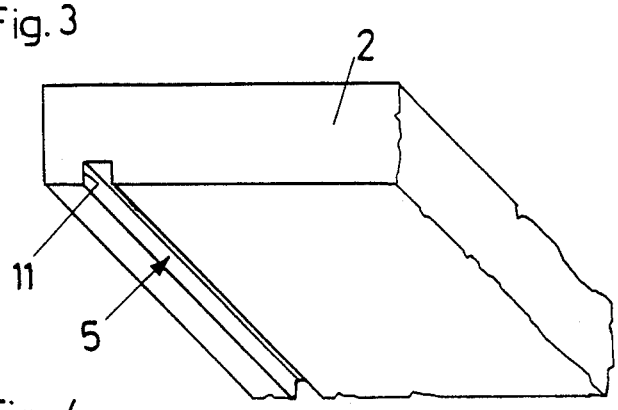
FIG. 3 is a partial perspective view of the bottom plate.

The bottom plate 2 is on each side provided with a continuous groove 5, as shown in FIG. 3. Each metal drawer side wall 1 comprises an upper horizontal flange 6, which serves in this embodiment as a running flange for a runner roller on the side of a furniture body (not shown), a central vertical flange 7 which forms the lateral limitation of the drawer, and a lower horizontal flange 8 on which the bottom plate 2 rests (see FIG. 2). Plural spaced hooks 9 are bent upwardly from the lower horizontal flange 8 of each drawer side wall 1, and hooks 9 are provided with pointed angular tips 10.

Figure 4:
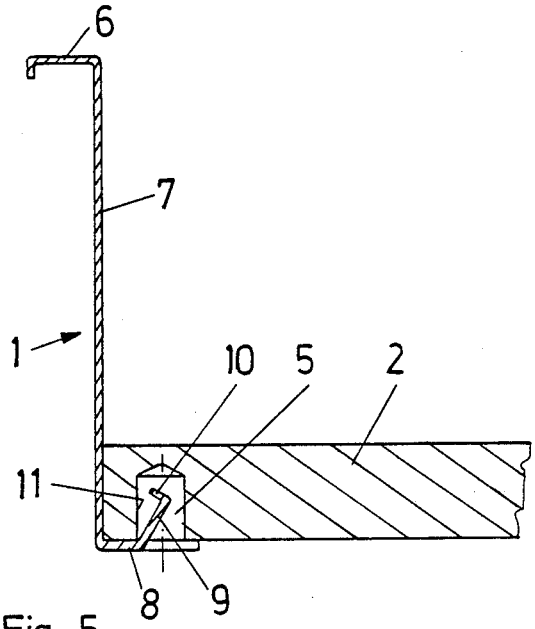
FIGS. 4 and 5 are vertical sectional views of the drawer side wall and the bottom plate in a region of connection therebetween and showing different stages of assembly.
Figure 5:
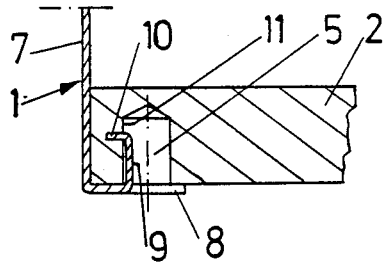
Figure 6:
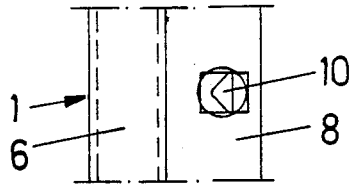
FIG. 6 is a top view of the drawer side wall in the region of a hook thereof.

When the bottom plate 2 is to be connected to or mounted on the drawer side walls 1, the hooks are advantageously in the position illustrated in FIG. 4. This means that they project freely upwardly into groove 5. When the bottom plate 2 is positioned on the horizontal flange 8, each hook 9 is deflected or bent further upwardly and outwardly toward flange 7 so that the tip 10 pierces and enters the wall 11 of the groove 5, as shown in FIG. 5. The hook 9 is thus clamped into the bottom plate 2, thereby obtaining a secure connection between the drawer side wall 1 and the bottom plate 2. As can be seen from FIG. 5, the tip 10 of hook 9 advantageously projects towards the vertical flange 7 of the drawer side wall 1.

Figure 7:
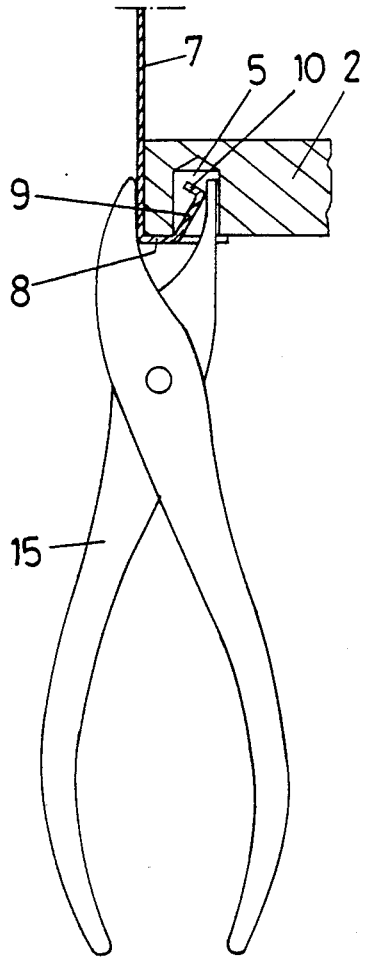
FIGS. 7 to 9 are partial vertical sectional views of the drawer side wall and the bottom plate in the region of connection therebetween and showing different methods of pressing a hook into a wall of a recess in the bottom plate.
Figure 8:
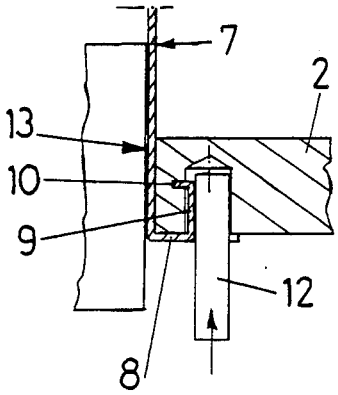
Figure 9:
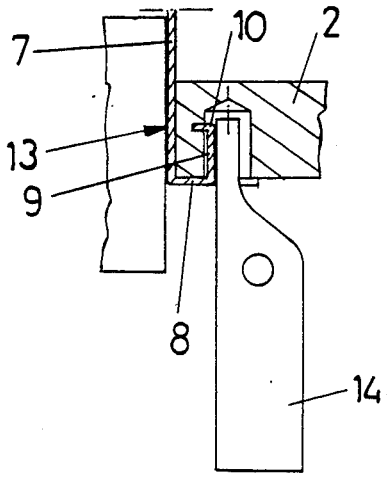

Clamping of the hooks 9 to the bottom plate 2 may, as shown in FIGS. 7 to 9, be obtained by means of different tools. FIG. 7, for example, shows the use of a special pair of pliers 15. FIG. 8 shows bending hook 9 by inserting a pin 12 into groove 5 and thus forcing hook 10 into wall 11. A stop 13 advantageously is provided as a backing to the force applied by pin 2. As can be seen in FIG. 9, bending of hook 9 may also be effected by means of a compressed-air lever system 14 which is schematically illustrated. In this arrangement, the vertical flange 7 of the drawer side wall 1 also advantageously abuts a stop 13.

What is claimed is:

1. A drawer comprising:

spaced metal side walls having respective vertical flanges forming drawer sides, each said vertical flange having extending inwardly from a lower end thereof a horizontal flange;

a drawer bottom plate of wood or the like resting at opposite sides thereof on said horizontal flanges of said side walls, said bottom plate having formed in the bottom thereof along each said side thereof a continuous groove;

said horizontal flange of each said side wall having punched therefrom a plurality of bendable hooks, each said bendable hook having a pointed tip;

each said hook being bent upwardly angularly from the respective said horizontal flange and extending into a respective said groove in said bottom plate; and each said pointed tip being bent angularly from the respective said hook and piercing a wall of the respective said groove to extend into the material of said bottom plate.

2. A drawer as claimed in claim 1, wherein each said tip extends in a direction toward said vertical flange of the respective said side wall.

* * * * *